US007537061B2

(12) United States Patent
Hall et al.

(10) Patent No.: US 7,537,061 B2
(45) Date of Patent: May 26, 2009

(54) SYSTEM AND METHOD FOR RELEASING AND RETRIEVING MEMORY TOOL WITH WIRELINE IN WELL PIPE

(75) Inventors: Joe Hall, Oklahoma City, OK (US); Sam Ash, Lincolnshire (GB); Scott Campbell, Dandridge, TN (US); Tim Marsh, Tomball, TX (US); Leonard Casey, The Woodlands, TX (US)

(73) Assignee: Precision Energy Services, Inc., Houston, TX (US)

( * ) Notice: Subject to any disclaimer, the term of this patent is extended or adjusted under 35 U.S.C. 154(b) by 262 days.

(21) Appl. No.: 11/423,909

(22) Filed: Jun. 13, 2006

(65) Prior Publication Data

US 2007/0284116 A1 Dec. 13, 2007

(51) Int. Cl.
*E21B 19/00* (2006.01)

(52) U.S. Cl. ..... 166/385; 166/250.01; 166/66; 166/65.1

(58) Field of Classification Search ..... 166/250.01, 166/385, 66, 65.1
See application file for complete search history.

(56) References Cited

U.S. PATENT DOCUMENTS 2,844,205 A * 7/1958 Carothers ..... 166/250.01
3,842,507 A 10/1974 Boucher
4,116,274 A * 9/1978 Rankin et al. ..... 166/250.01
4,488,597 A * 12/1984 Hoppe et al. ..... 166/254.2
4,570,709 A 2/1986 Wittrisch
4,669,537 A * 6/1987 Rumbaugh ..... 166/113
4,899,832 A 2/1990 Bierscheid, Jr.
4,909,321 A * 3/1990 Petree ..... 166/72

(Continued)

FOREIGN PATENT DOCUMENTS

WO 98/06227 A2 2/1998

(Continued)

OTHER PUBLICATIONS

Ferguson Beauregard "Downhole Equipment: Bumper Spring/Collar lock" Mar. 11, 2006, http://www.fergusonbeauregard.com/products/dheproducts/index.shtml- date obtained from http://web.archive.org.*

(Continued)

*Primary Examiner*—William P Neuder
*Assistant Examiner*—Cathleen R Hutchins
(74) *Attorney, Agent, or Firm*—Wong, Cabello, Lutsch, Rutherford & Brucculeri, LLP

(57) ABSTRACT

Memory tool deployment method, system, and apparatus include a landing ring fit on a pipe deployed in a well. A drop-off tool has a landing collar and has a tool string with one or more memory tools. The drop-off tool is connected to a wireline and is deployed through the pipe in the well with the wireline. The drop-off tool is landed on the landing ring on the pipe so that the memory tools extend beyond the pipe. The wireline is released from the drop-off tool and is removed from the pipe so that logging operations can be performed. After logging, the wireline is redeployed in the pipe in the well and is reconnected to the drop-off tool to retrieve the memory tools from the pipe.

28 Claims, 8 Drawing Sheets

U.S. PATENT DOCUMENTS

| | | | | |
|---|---|---|---|---|
| 4,986,690 | A * | 1/1991 | Cooksey | 403/319 |
| 5,130,705 | A | 7/1992 | Allen et al. | |
| 5,172,776 | A | 12/1992 | Wilschek | |
| 5,209,304 | A | 5/1993 | Nice | |
| 5,289,845 | A | 3/1994 | Sipos et al. | |
| 5,353,877 | A | 10/1994 | Decorps et al. | |
| 5,358,418 | A * | 10/1994 | Carmichael | 439/190 |
| 5,389,003 | A * | 2/1995 | Van Steenwyk et al. | 439/191 |
| 5,404,948 | A * | 4/1995 | Fletcher | 166/250.17 |
| 5,547,314 | A | 8/1996 | Ames | |
| 5,605,192 | A | 2/1997 | Bjornstad | |
| 5,826,195 | A | 10/1998 | Westerlage et al. | |
| 6,029,744 | A | 2/2000 | Baird | |
| 6,062,315 | A | 5/2000 | Reinhardt | |
| 6,064,210 | A | 5/2000 | Sinclair | |
| 6,078,821 | A | 6/2000 | Kaschke et al. | |
| 6,119,777 | A | 9/2000 | Runia | |
| 6,148,664 | A | 11/2000 | Baird | |
| 6,167,064 | A | 12/2000 | Cohn et al. | |
| 6,170,573 | B1 * | 1/2001 | Brunet et al. | 166/153 |
| 6,179,055 | B1 | 1/2001 | Sallwasser et al. | |
| 6,189,621 | B1 | 2/2001 | Vail, III | |
| 6,225,719 | B1 | 5/2001 | Hallunbaek | |
| 6,263,137 | B1 | 7/2001 | Yoneyama et al. | |
| 6,273,189 | B1 | 8/2001 | Gissler et al. | |
| 6,295,449 | B1 | 9/2001 | Westerlage et al. | |
| 6,296,066 | B1 | 10/2001 | Terry et al. | |
| 6,397,946 | B1 | 6/2002 | Vail, III | |
| 6,419,013 | B1 * | 7/2002 | Milne et al. | 166/254.2 |
| 6,419,014 | B1 | 7/2002 | Meek et al. | |
| 6,431,269 | B1 * | 8/2002 | Post et al. | 166/65.1 |
| 6,527,064 | B1 | 3/2003 | Hallundbaek | |
| 6,554,075 | B2 | 4/2003 | Fikes et al. | |
| 6,557,642 | B2 | 5/2003 | Head | |
| 6,578,631 | B2 * | 6/2003 | Milne et al. | 166/66 |
| 6,598,687 | B2 | 7/2003 | Eppink et al. | |
| 6,607,044 | B1 | 8/2003 | Eppink et al. | |
| 6,609,565 | B1 | 8/2003 | Andrechuk et al. | |
| 6,655,453 | B2 | 12/2003 | Head | |
| 6,659,200 | B1 | 12/2003 | Eppink | |
| 6,677,856 | B2 | 1/2004 | Perlman et al. | |
| 6,719,062 | B2 | 4/2004 | Fikes et al. | |
| 6,745,853 | B2 | 6/2004 | Turner et al. | |
| 6,763,889 | B2 | 7/2004 | Rytlewski et al. | |
| 6,799,633 | B2 | 10/2004 | McGregor | |
| 6,810,315 | B2 | 10/2004 | Cessac | |
| 6,843,332 | B2 | 1/2005 | Eppink et al. | |
| 6,868,906 | B1 | 3/2005 | Vail, III et al. | |
| 6,868,913 | B2 | 3/2005 | Vidrine et al. | |
| 6,920,936 | B2 | 7/2005 | Sheiretov et al. | |
| 6,923,273 | B2 | 8/2005 | Terry et al. | |
| 6,932,155 | B2 | 8/2005 | Vinegar | |
| 6,969,123 | B2 | 11/2005 | Vinegar et al. | |
| 6,970,074 | B2 | 11/2005 | Perlman | |
| 7,188,672 | B2 * | 3/2007 | Berkheimer et al. | 166/254.2 |
| 2002/0117300 | A1 * | 8/2002 | Spencer et al. | 166/254.2 |
| 2003/0234110 | A1 * | 12/2003 | McGregor | 166/373 |
| 2004/0074639 | A1 * | 4/2004 | Runia | 166/254.2 |

FOREIGN PATENT DOCUMENTS

| | | | |
|---|---|---|---|
| WO | 00/46481 | A2 | 8/2000 |
| WO | 00/60212 | A1 | 10/2000 |
| WO | 01/12946 | A1 | 2/2001 |
| WO | 01/12949 | A1 | 2/2001 |
| WO | 01/46549 | A1 | 6/2001 |
| WO | 01/48352 | A1 | 7/2001 |
| WO | 01/88331 | A1 | 11/2001 |
| WO | 03/040513 | A2 | 5/2003 |
| WO | 03/042488 | A2 | 5/2003 |
| WO | 03/067018 | A2 | 8/2003 |
| WO | 2004/001177 | A2 | 12/2003 |
| WO | 2004/020789 | A2 | 3/2004 |
| WO | 2004/027198 | A2 | 4/2004 |
| WO | 2004/031527 | A2 | 4/2004 |
| WO | 2004/033840 | A2 | 4/2004 |
| WO | 2004/046499 | A1 | 6/2004 |
| WO | 2004/053935 | A2 | 6/2004 |
| WO | 2004/072437 | A1 | 8/2004 |
| WO | 2004/083595 | A2 | 9/2004 |
| WO | 2005/052305 | A1 | 6/2005 |
| WO | 2005/090739 | A1 | 9/2005 |

OTHER PUBLICATIONS

Welltec, "Products," obtained from http://www.welltractor.com/products_introduction_p.html, generated Mar. 13, 2006, 1-pg.

Welltec, "See the Work," obtained from http://www.welltractor.com/products_product_line_s_p.html, generated Mar. 13, 2006, 1-pg.

Welltec, "Products," obtained from http://www.welltractor.com/products_product_line_p.html, generated May 25, 2006, 3-pgs.

Welltec, "Products/Well Tractor(R) 318," obtained from http://www.welltractor.com/products_specif318_p.html, generated May 25, 2006, 1-pg.

Weathorford, "Imaging," obtained from http://www.weatherford.com/weatherford/groups/public/documents/evaluation/eoh_imagin . . . , generated May 25, 2006, 2-pgs.

Weathorford International Ltd., "Real Results / Compact(TM) Technology Saves More Than $100,000 in Formation Evaluation Costs," copyright 2006, 1-pg.

Weathorford International, Ltd., "Compact(TM) Well Shuttle," copyright 2006, 2-pgs.

Weathorford International, Ltd., "Real Results / Compact(TM) Well Shuttle System Enables Open-hole Logging of Highly Deviated Well in Extreme Conditions," copyright 2006, 1-pg.

Weathorford International, Ltd., "Real Results / Compact(TM) Well Shuttle System Provides Precise Casing Correlation for Whipstock Placement, Saves Rig Time," copyright 2006, 1-pg.

Ferguson Beauregard, "Down Hole Equipment—Bumper Spring/Collar Lock; Bumper String/Tubing Stop; Bumper Spring/Standing Valve; and Bumper Spring w/Collet Latch," obtained from http://www.fergusonbeauregard.com . . . , generated Jun. 13, 2006, 10-pgs.

Icefield Tools Corporation, "Products Page," obtained from http://www.icefieldtools.com/products/mi3.htm, generated Jun. 13, 2006, copyright 2004, 4-pgs.

Icefield Tools Corporation, "Borehole Surveying," obtained from http://www.icefieldtools.com/docs/instrument_en.pdf, generated Jun. 13, 2006, v2004-02, 2-pgs.

Icefield Tools Corporation, "How it works / MI-3 Digital Borehole Survey Tools," obtained from http://www.icefieldtools.com/docs/mi3_howitworks_en.pdf, generated Jun 13, 2006, undated, 1-pg.

Icefield Tools Corporation, "Selected Case Histories / MI-3 Digital Borehole Survey Tools," obtained from http://www.icefieldtools.com/docs/case_studies_en.pdf, generated Jun 13, 2006, undated, 1-pg.

Icefield Tools Corporation, "Accessories / MI-3 Digital Borehole Survey Tools," obtained from http://www.icefieldtools.com/docs/accessories_en.pdf, generated Jun. 13, 2006, undated, 2-pgs.

UK Intellectual Ppty. Office, Combined Search and Examination Report for Appl. No. GB0707112.9, dated Jun. 2007, 4-pgs.

UK Intellectual Ppty. Office, Combined Search and Examination Report for Appl. No. GB0707112.9, dated Sep. 16, 2008, 2-pgs.

* cited by examiner

SYSTEM AND METHOD FOR RELEASING AND RETRIEVING MEMORY TOOL WITH WIRELINE IN WELL PIPE

FIELD OF THE DISCLOSURE

The subject matter of the present disclosure generally relates to drilling technology and more particularly relates to a system and method for releasing and retrieving a memory tool in a well hole through a drill pipe using a wireline.

BACKGROUND OF THE DISCLOSURE

Memory or logging tools are used in wells to record data pertaining to a number of characteristics of the wells. One technique for deploying a logging tool in a well involves inserting the tool into a typical vertical borehole using a wireline and allowing gravity to lower the memory tool to a desired depth. The tool is then lifted with the wireline at a selected rate during a logging operation. In another technique often referred to as pipe-conveyed logging, a memory tool is attached to the end of a string of pipe or coil tubing and is lowered and raised in the well using the pipe. The memory tool is battery powered and stores collected data, which can be obtained once the tool is removed from the well. In yet another technique, a memory tool is forced by hydraulic pressure through a drill pipe in the well so that the tool reaches the end of the pipe. The drill pipe is pulled from the well and the tool logs characteristics of the well.

Deploying memory tools in wells can offer a number of challenges for rig operators. In one example, some wells may be deviated and may have substantially horizontal sections making deployment of memory tools difficult. In another example, well bores may have conditions that are detrimental to the tools and their passage along the bore. The subject matter of the present disclosure is directed to overcoming, or at least reducing the effects of, one or more of the problems set forth above.

SUMMARY OF THE DISCLOSURE

An embodiment of a memory tool deployment method involves fitting a landing ring assembly onto the bottom of a pipe and deploying the pipe in a well. A drop-off tool having a tool string with a landing collar and one or more memory tools is connected to a wireline and is deployed through the pipe in the well with the wireline. The landing collar on the top of the tool string engages the landing ring assembly at the bottom of the pipe, thereby allowing measurement sensors of the memory tools to be deployed into the open hole while keeping the top of the tool string retained within the pipe. The wireline is released from the top of the tool string and removed from the pipe, and the pipe can be moved through the hole so the memory tools can record logging data. Once logging is completed, the wireline is redeployed in the pipe in the well and is reconnected to the memory tool so the memory tool can be retrieved from the pipe and/or data can be downloaded from the memory tool.

In one embodiment, a memory tool deployment system includes a landing assembly, a coupling member, and a deployable tool. The landing assembly has a housing that fits onto pipe for deployment in a well hole, and the landing assembly defines a passage having a landing ring. The coupling member is connectable to a coupling mechanism attached to a wireline deployable through the pipe. The tool is deployable though the pipe in the well and is deployable at least partially through the passage in the landing assembly.

The tool is connected to the coupling member, which is connectable to the coupling mechanism on the wireline. The tool has a landing collar that engages with the landing ring. The memory tool on the deployable tool extends beyond the landing ring when the tool is landed. The system can also use a tractor connected to the wireline so that the deployable tool can be moved through the pipe in the event it becomes substantially hindered, or to traverse highly deviated or horizontal well bores.

In one embodiment, a memory tool deployment apparatus includes an elongated body, a coupling member, and a landing collar. The elongated body has first and second ends and is deployable with a wireline through a bore of pipe in a well. The first end supports a memory tool. The coupling member is connected to the second end of the elongated body and is connectable to a coupling mechanism attached to the wireline deployable through the bore of the pipe. The landing collar is positioned on the elongated body and is used to engage a landing ring in the bore of the pipe to stop the apparatus in the pipe. The landing collar can be movable on the elongated body, and at least one spring can be positioned on the elongated body to bias movement of the landing collar relative to the second end of the elongated body.

The foregoing summary is not intended to summarize each potential embodiment or every aspect of the present disclosure.

BRIEF DESCRIPTION OF THE DRAWINGS

The foregoing summary, preferred embodiments, and other aspects of subject matter of the present disclosure will be best understood with reference to a detailed description of specific embodiments, which follows, when read in conjunction with the accompanying drawings, in which.

Figure 1:
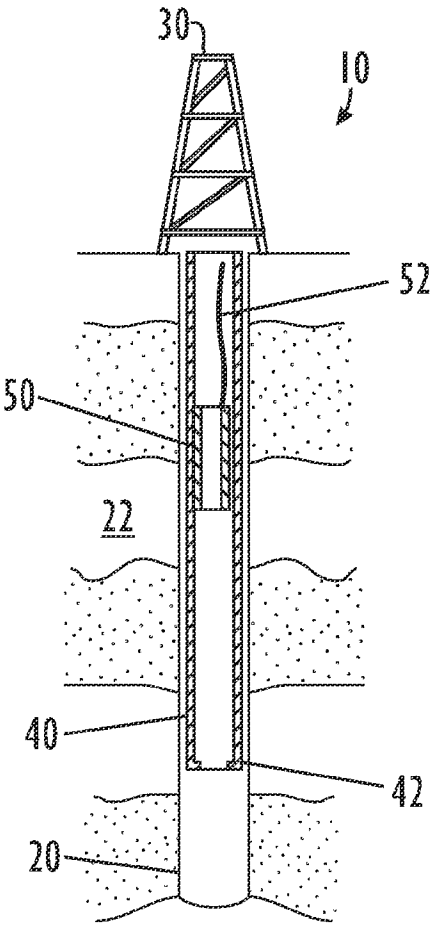
FIGS. 1 through 6 diagrammatically illustrate stages of using a wireline drop-off system to release and retrieve memory tools according to certain teachings of the present disclosure.

While the subject matter of the present disclosure is susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person skilled in the art by reference to particular embodiments, as required by 35 U.S.C. § 112.

DETAILED DESCRIPTION

Referring to FIGS. 1 through 6, a wireline drop-off system 10 according to certain teachings of the present disclosure is illustrated during various stages of operation. The wireline drop-off system 10 and associated methods of the present disclosure are used to deploy a memory logging tool or other tool used in drilling technologies in a well hole.

In FIG. 1, a drilling rig 30 and some other components of the wireline drop-off system 10 are diagrammatically illustrated relative to a well hole 20 in a formation 22. Drill pipe or coil tubing 40 is shown positioned in the hole 20. To ensure that components of the wireline drop-off system 10 can be deployed though the pipe 40, it is first necessary to determine that the inside diameter of the drill pipe 40 is sufficiently large enough to allow passage of a memory tool (also referred to herein as a 'tool string'). This can be achieved by various techniques know and used in the art. One technique employs a suitably sized 'drift' or mandrel that is passed through the internal bore of the drill pipe 40. For example, the rig operators attach a rigid wire 52 or the like to a drift 50 and then drop the drift 50 into the pipe 40 from the surface. In one implementation, the wire 52 can be about 120' long, and the outside diameter of the drift 50 may be about 2.7-inches in diameter, for example, for pipe 40 having a slightly larger nominal diameter. Preferably, the drift 50 is ported through its center so that mud or other drilling fluids are allowed to flow through the drift 50 when it eventually lands at the bottom of the pipe 40. The drift 50 travels along the inside of the pipe 40 being forced by gravity until it either reaches a narrow portion of the pipe 40 or lands on the drill collar or the bottom hole assembly 42.

Figure 2:
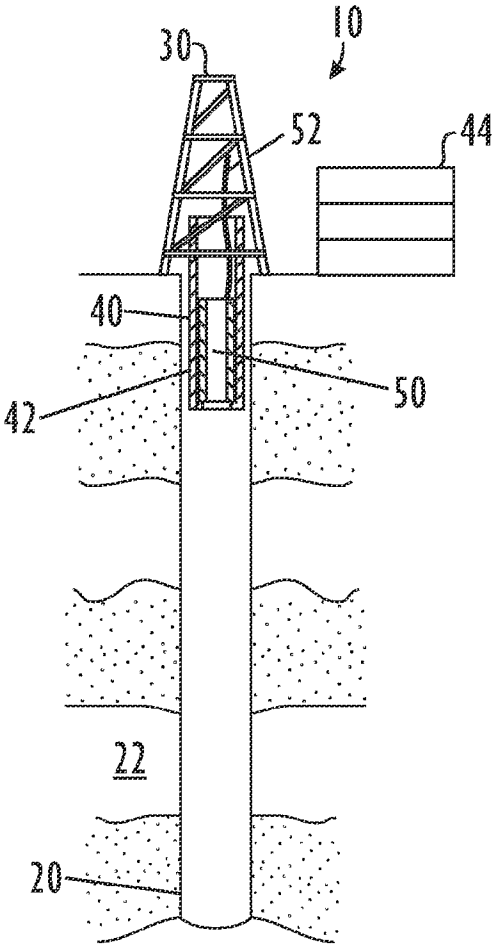

In FIG. 2, the drift 50 is shown landed on a drill collar or bottom hole assembly 42 of the pipe 40, and the rig 30 has pulled the pipe 40 toward the surface. As the pipe 40 is tripped out of the hole 20, each stand 44 of pipe 40 is sequentially numbered, measured for length, and the information is recorded so that the stands 44 of pipe 40 can be reused in the same order when positioning the pipe 40 back into the hole 20 during later stages. As the rig 30 pulls the pipe 40, the rig operators look for the rigid wire 52 protruding from the top of the connections of pipe 40. If the rigid wire 52 is found protruding from the top of the bottom hole assembly 42, then all of the stands 44 of previously pulled pipe 40 will allow components of the wire line drop-off system 10 to traverse the pipe 40 in later stages.

The bottom hole assembly 42 is removed, and the length of this section is added to the lengths of pulled pipe 40 so that the resulting measurement of pipe 40 to be used in later stages will reach the bottom of the hole 20. Any new pipe added to the stand 44 of pipe 40 is also drifted with the drift 50 to ensure it has a sufficient inside diameter. If the drift 50 does not reach the bottom hole assembly 42, the length of pipe 40 that the drift 50 was unable to traverse is determined, and additional pipe 40 is drifted and added to the stands 44 of pipe 40.

Figure 3:
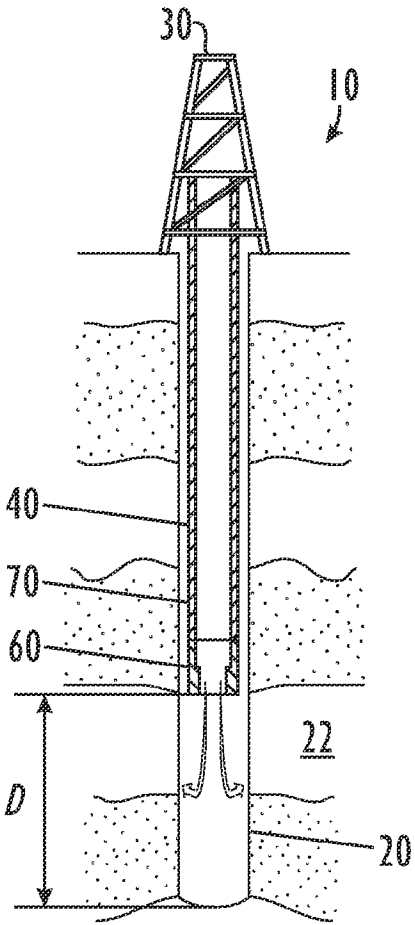

Turning next to FIG. 3, a landing assembly 60 is assembled. The landing assembly 60 includes a landing ring 62 and can include a slotted sleeve (not shown) to allow mud to circulate. As will be discussed below, a wireline drop-off tool deployed through the pipe will eventually abut against the landing ring 62 on the assembly 60 so that a portion of the tool can extend beyond the pipe 40 but can retain a physical connection to the landing assembly 60. Components of the landing assembly 60 are callipered, and the wireline drop-off tool (discussed in more detail below) is passed into the assembly 60 to verify that an internal shoulder of the landing ring 62 will actually stop passage of the drop-off tool when deployed through the pipe 40. In one implementation, the landing ring 62 may have an inside diameter of 2.5-in. when used with pipe 40 having a nominal diameter of about 2.7-in. or slightly greater.

The length of the landing assembly 60 is recorded, and the landing assembly 60 is then fit onto the end of the first stand 44 of previously used pipe 40. Then, the landing assembly 60 is lowered into the hole 20 as the stands 44 of pipe 40 are tripped into the hole 20. It may be desirable to use a reamer shoe (not shown) on the end of the landing assembly 60 to help clear the hole 20 as the pipe 40 is lowered. Preferably, borehole fluid (e.g., mud) is circulated during deployment to remove any debris from the hole 20 and to reduce sticking of the pipe 40. In addition, mud is preferably circulated again when the pipe 40 reaches the bottom of the hole 20.

After reaching total depth, the pipe 40 is then pulled back a sufficient distance D (plus any desired safety margin) to accommodate portion of the wireline drop-off tool that is intended to extend beyond the landing assembly 60 when deployed in the pipe 40. For example, the pipe 40 is pulled back a distance that is about equal to a length of the portion of the tool intended to extend beyond the landing assembly 60 plus approximately ten feet.

With the pipe 40 positioned in the manner described above, a wireline drop-off tool 110 shown in FIG. 4 is then rigged up on a wireline 102 of a wireline unit 100. The wireline drop-off tool 110 has an elongated body and includes a landing collar 112 and a coupling member 114. In addition, the tool 110 supports a tool string 120 that includes one or more memory tools 150 capable of recording data in memory. The coupling member 114 of the tool 110 is coupled to a coupling mechanism 104 on the end of the wireline 102. Various types of coupling mechanisms 104 and coupling members 114 known in the art can be used with the drop-off system 10.

Using the wireline unit 100 and wireline 102, the wireline drop-off tool 110 is deployed through the bore of the pipe 40. Details related to the wireline unit 100 are know to those skilled in the art and are not discussed in detail here. In general, placement and operation of the wireline unit 100 may depend on the particular implementation or desired set up. For top drive rigs 30, for example, the top sheave wheel (not shown) of the wireline unit 100 may need to hang on the side of the derrick, and the bottom sheave (not shown) may need to be tied somewhere other than through the rotary table of the rig 30. Various pressure control equipment may also be rigged above the pipe 40 or rigged on a side entry sub if a top drive is to be used.

Figure 5B:
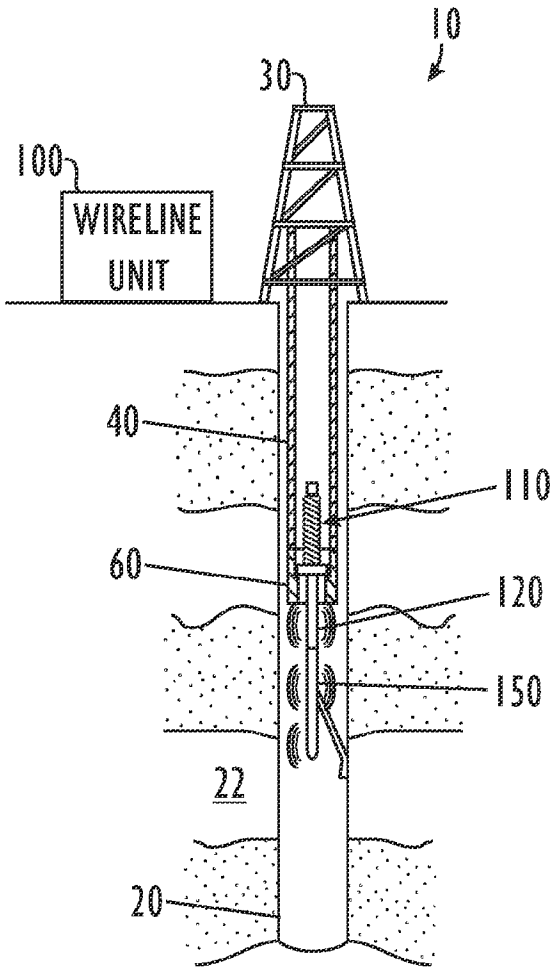
Figure 5A:
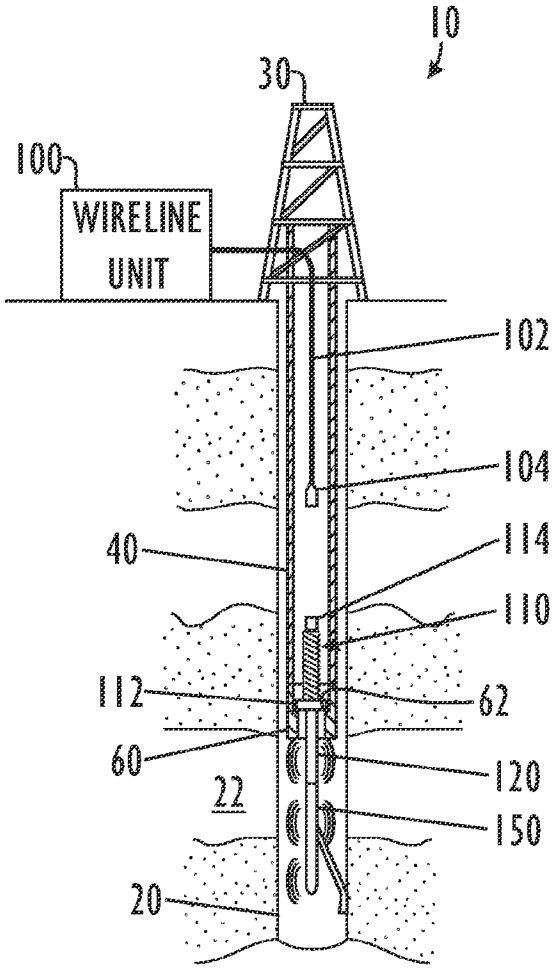
Figure 4:
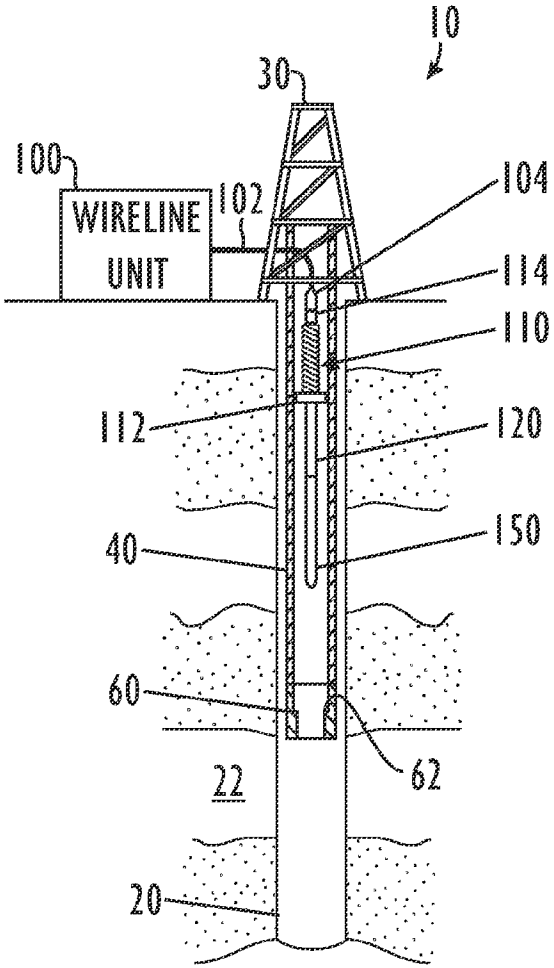

Turning now to FIG. 5A, portion of the tool string 120 having the memory tools 150 has eventually passed through the landing ring 62 as the wireline drop-off tool 110 reaches the bottom of the pipe 40. Ultimately, the decent of the wireline drop-off tool 110 down the pipe 40 is stopped when the landing collar 112 of the tool 110 engages the landing ring 62 of the landing assembly 60. The memory tools 150 on the tool string 120, therefore, extend beyond the end of the pipe 40. In one embodiment, the landing collar 112 is fixedly positioned on the elongated body of the wireline drop-off tool 110. In another embodiment, the landing collar 112 is preferably movable to some extent along the length of the elongated body of the tool 110, and one or more springs are used to bias movement of the landing ring 62 relative to the upper end of the elongated body of the tool 110 where a coupling member 114 is located.

The wireline unit 100 preferably communicates with the tool 110 via the wireline 102 to ensure that the memory tools 150 are functioning correctly and to ensure that any calipers on the tool string 120 can be opened and verified. A number of possible ways are available for communicating with the memory tools 150 while deployed in the pipe. In one embodiment, for example, the coupling mechanism 104 on the wireline 102 can form a wet connection with the tool 110 by mechanically and electrically connecting to the coupling member 114 of the tool 110 so that the wireline unit 100 can establish real-time communication with the memory tools 150.

With the drop-off tool 110 landed on the landing assembly 60, the wireline unit 100 actuates the coupling mechanism 104 to release from the coupling member 114 of the drop-off tool 110, and the wireline 102 is then pulled out of the hole 20. Then, the rig 30 starts to pull the pipe 40 slowly out of the hole 20 to the surface, as shown in FIG. 5B. Preferably, the pipe 40 is pulled at a constant speed, and standard logging techniques known in the art are preferably used to record data in the memory tools 150.

In FIG. 5B, a portion of the hole 20 has been surveyed by withdrawing the pipe 40 from the hole 20 while the memory tools 150 have recorded data versus time. Preferably, the memory tools 150 are battery powered and have memory for storing the recorded data. With logging completed, the pipe 20 is stopped so that the memory tools 150 can be retrieved to obtain the stored data. A number of possible ways are available for communicating with the memory tools 150 while the drop-off tool 110 is deployed in the pipe 40. In one embodiment, for example, the tool string 120 can be equipped with a component (not shown) of a mud pulse telemetry system. While the drop-off tool 110 is still deployed, mud pulses can be used to communicate with the mud pulse telemetry components and the memory tools 150 and can be used to obtain data or control operation.

Figure 6:
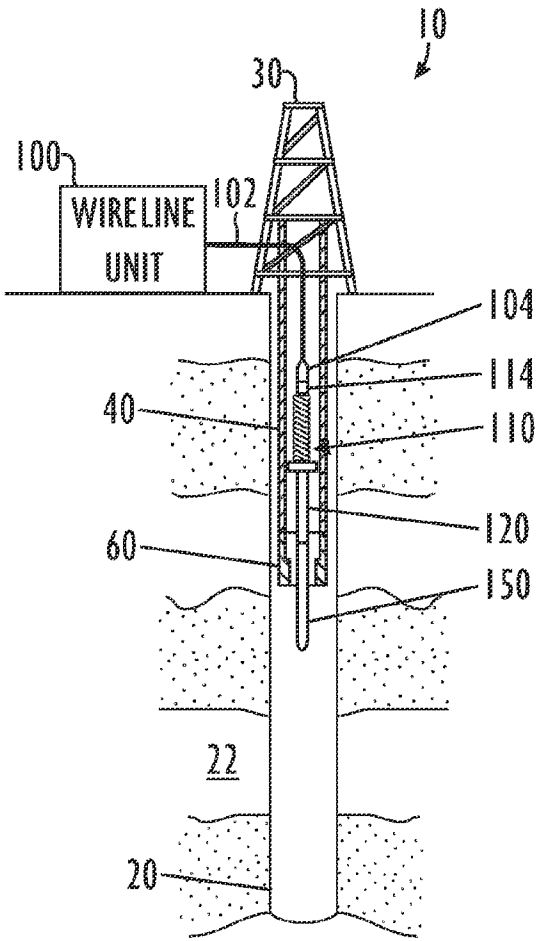

Turning to FIG. 6, the wireline drop-off system 10 is illustrated in a retrieval stage once a certain interval has been logged and no more log data is required. Determining how to retrieve the drop-off tool 110 can depend how deep of the top of the logged interval is in the well. For example, if the top of the logged interval is relatively deep within the well (i.e., the drop-off tool 110 is still positioned deep in the well after logging), then retrieving the drop-off tool 110 with the wireline 102 is preferred. On the other hand, leaving the drop-off tool 110 in the pipe 40 and retrieving it by pulling the pipe 40 to the surface may be used when appropriate.

In FIG. 6, the wireline 102 is shown retrieving the drop-off tool 110. In this retrieval stage, the pipe 40 is held stationary, and the wireline unit 100 spools the wireline 102 back in the pipe 40 to reattach the coupling mechanism 104 to the coupling member 114 of the tool 110. Once coupled, the wireline drop-off tool 110 along with the memory tool 150 can be removed from the pipe 40 with the wireline 102 and unit 100. The data stored in the memory tool 150 can be downloaded when the coupling mechanism 104 forms a wet connection with the tool 110. Alternatively, the data can be obtained after the drop-off tool 110 is removed from the pipe 40.

If the wireline 102 once coupled to the drop-off tool 110 cannot pull the memory tools 150 through landing ring 62 due to debris, blockage, etc., then the wireline unit 102 is uncoupled from the drop-off tool 110 and is spooled out of the pipe 40. Then, the rig 30 pulls the pipe 40 to surface so the debris can be cleared and the drop-off tool 110 can be removed.

In embodiments discussed previously, the memory tools 150 are deployed and/or retrieved through the bore of the pipe 40 inserted in the hole 20. The deployment methods discussed above can be used in traditional open and cased hole wells. As also discussed in previous embodiments, the memory tools 150 are shown deployed in a vertical hole. However, the techniques associated with the deploying the wireline drop-off tool 110 can be used in deviated or horizontal wells. In addition, other possibilities exist for rigging up the wireline drop-off tool 110, tool string 120, and memory tools 150 depending on what techniques are to be used to deploy them and depending on what techniques are to be used to communicate with them before being released and after being retrieved.

Figure 7:
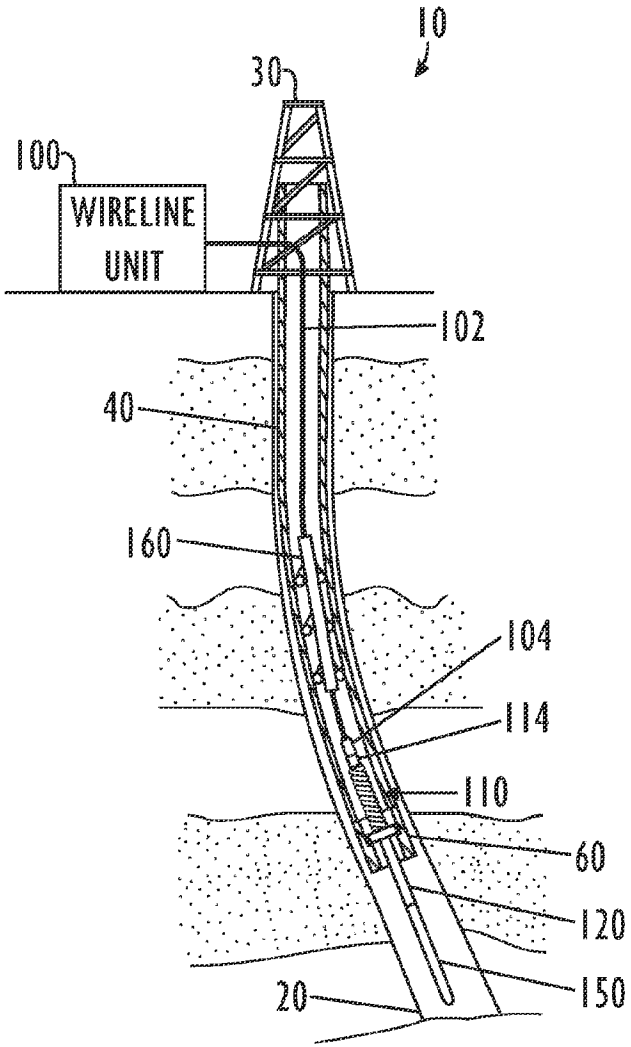
FIG. 7 illustrates an embodiment the wireline drop-off system equipped with a well or cased hole tractor.

In one alternative embodiment shown in FIG. 7, for example, the wireline drop-off system 10 is equipped with a well tractor 160 in conjunction with the other components discussed in previous embodiments. The tractor 160 can be used in the event that the deployment of the wireline drop-off tool 110 in the pipe 40 becomes hindered for whatever reason, such as by debris or deviated section of the well. As shown in FIG. 7, for example, the hole 20 can have a deviated section so that frictional forces within the pipe 40 may prevent deployment of the wireline drop-off tool 110 using gravity forces alone.

Using many of the same procedures discussed previously, the pipe 40 is outfitted with the landing assembly 60 prior of to being run in the hole 20. The tractor 160 is connected to the wireline 102 and to the wireline drop-off tool 110, which has the tool string 120 with the memory tools 150. Then, the tractor 160 and drop-off tool 110 are deployed through the pipe 40 with the wireline 102 and wireline system 100. At some point in the deployment, the deviation in the hole 20 and pipe 40 may prevent the tractor 160 and drop-off tool 110 from being conveyed by gravity fall through the pipe 40. To monitor the deployment, the position of the tractor 160 and drop-off tool 110 in the pipe 40 is continually monitored using depth encoders (not shown) on the tool string 120 and/or tension measurements of the wireline 102 at the surface. If the drop-off tool 110 and tractor 160 come to a halt due to frictional forces overcoming the force of gravity in the pipe 40, the tractor 160 is activated to continue the decent of the drop-off tool 110 to the landing assembly 60. Examples of some suitable devices for the tractor 160 include Well Tractors® available from Welltec®.

Once the drop-off tool 110 reaches the landing assembly 60, the wireline unit 100 actuates to release the wireline 102 and tractor 160 from the drop-off tool 110. For example, a trigger pulse can be sent from surface to activate the release mechanism between the end of the wireline 102 and the drop-off tool 110. Once released, the tractor 160 is pulled out of the hole 20 with the wireline 102, and the tool string 120 having the memory tools 150 is left extending beyond the landing assembly 60. Then, logging operations can be performed by pulling the pipe 40 from the hole 20 at logging speed.

When the drop-off tool 110 is to be removed, the wireline 102 and tractor 160 are conveyed through the pipe 40. Where deviation prevents gravity fall, the tractor 160 can again be motored until the drop-off tool 110 is reached. The coupling mechanism 104 of the wireline 102 is then connected to the coupling member 114 on the drop off tool 110. Acquired data from the memory tools 150 can be downloaded once the wireline 102 is connected. The tractor 160 and the drop-off tool 110 can then removed by the wireline 102 and by actuating the tractor 160 where needed.

Now that an understanding of how the wireline drop-off system 10 releases and retrieves memory tools using a wireline through pipe in a well, reference is now made to FIGS. 8 through 17B to discuss particular components of an embodiment of a landing assembly and a wire-line drop off tool according to certain teachings of the present disclosure.

Figure 8:
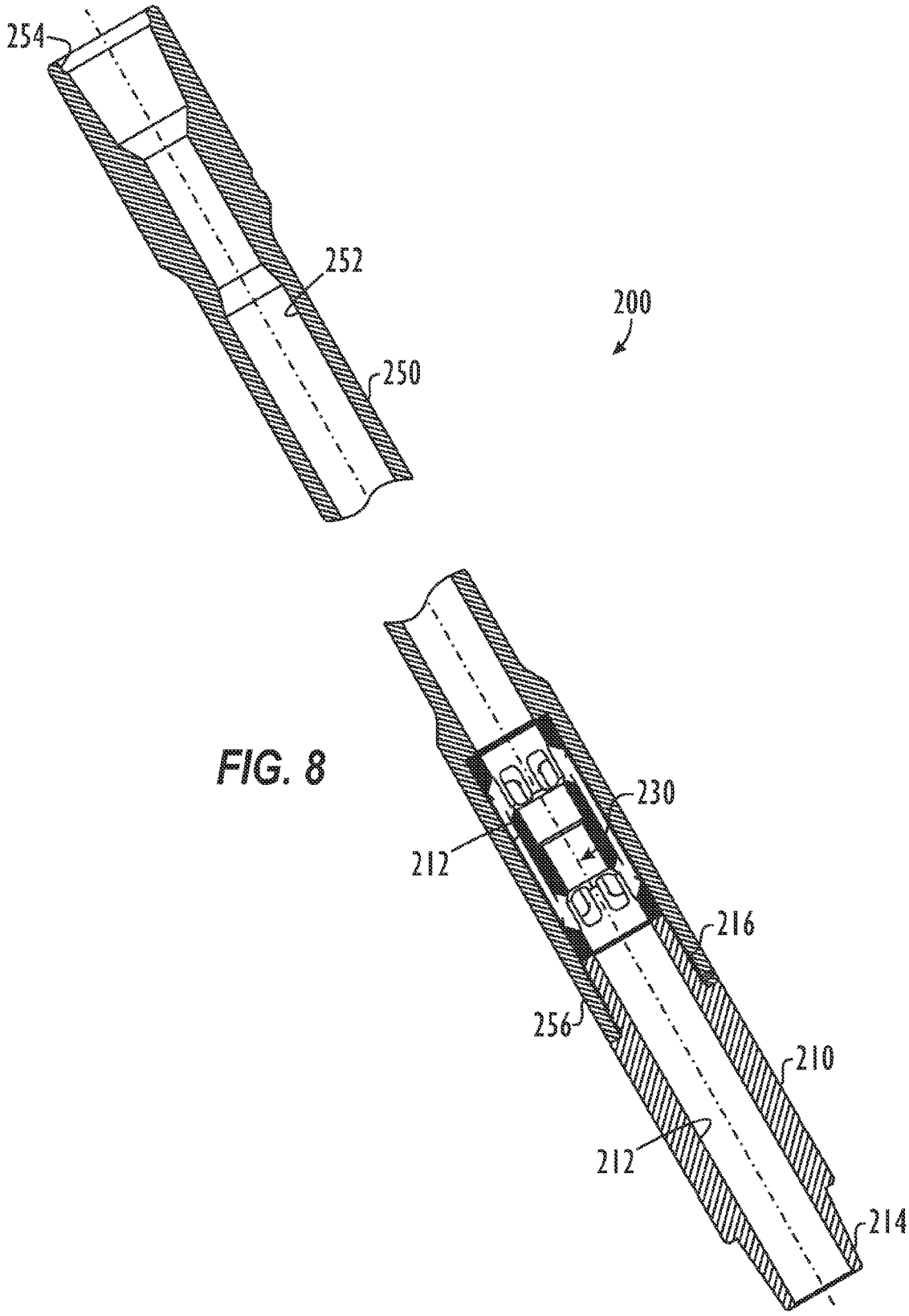
FIG. 8 illustrates an embodiment of a landing assembly according to certain teachings of the present disclosure in cross-section.

In FIGS. 8 through 11B, an embodiment of a landing assembly 200 according to certain teachings of the present disclosure is illustrated in various views. In FIG. 8, for example, the landing assembly 200 is show in a cross-sectional view in an assembled state. The landing assembly 200 includes a first or "lower" housing 210, a flow insert 230, and a second or "upper" housing 250. In one particular implementation, the overall length of the landing assembly 200 is about 77-inches.

Figure 9:
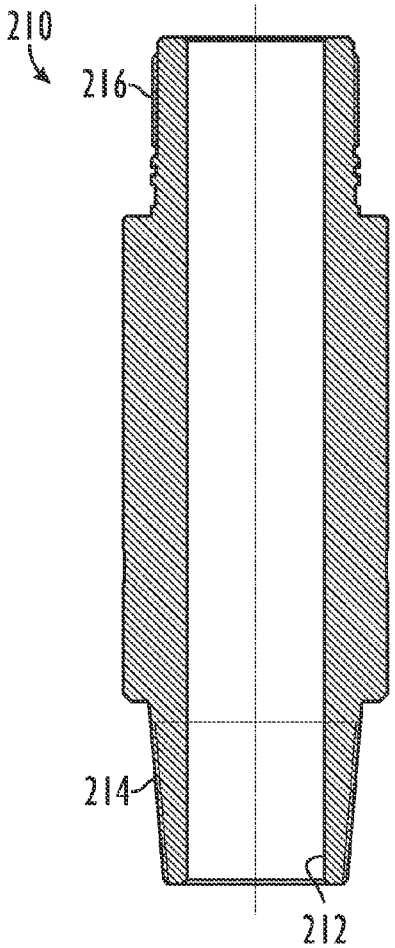
FIG. 9 illustrates a cross-sectional view of a lower housing of the landing assembly of FIG. 8.

The lower housing 210, which is also shown in isolated cross-section in FIG. 9, is preferably made of heat-treated steel, such as SAE 4150. The lower housing 210 has an internal bore 212 for passage of components of the wireline drop-off tool discussed below. In one implementation, the overall internal diameter of the bore 212 is about 3.37-inches, and the overall outside diameter of the housing 210 is about 6.5-inches. The lower housing 210 also has a first "lower" end 214 that have a 4½-inch American Petroleum Institute (API) standard I.F. Pin connection, and the lower housing 210 has a second "upper" end 216 that may have a 5¹⁄₁₆-in. thread.

Figure 10:
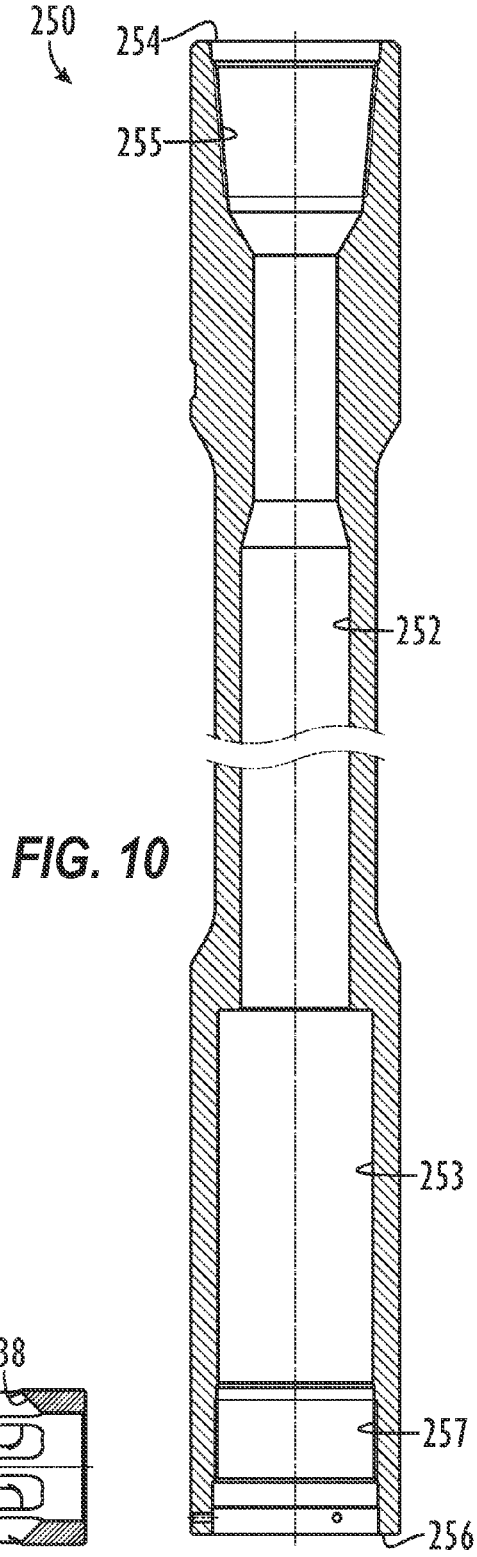
FIG. 10 illustrates a cross-sectional view of an upper housing of the landing assembly of FIG. 8.

The second "upper" housing 250, which is also shown in an isolated cross-sectional view in FIG. 10, is also preferably made of heat-treated steel, such as AISI 4150. The upper housing 250 has an internal bore 252 for passage of components of the wireline drop-off tool discussed below. In one implementation, the majority of the bore 252 has an internal diameter of about 3.37-inches. However, one portion of the bore 252 may have a reduced internal diameter of about 2.5-inches near the location of a fishneck (not shown) of the drop-off tool discussed below. The upper housing 250 has a first "upper" end 254 that may have a 4½-inch API I.F. Box connection and has a second "lower" end 256 that may have a 5¹⁄₁₆-in. internal thread.

The upper end 254 of the upper housing 250 connects to pipe (not shown) used to convey the landing assembly 200 into a well hole. The lower end 256 of the upper housing 250 attaches to the upper end 216 of the lower housing 210. The internal bore 252 of the upper housing 250 near the lower end 256 defines a chamber 253 of increased diameter for holding the flow insert 230. In one implementation, the increased diameter of the chamber 253 is about 4.8-inches.

Figure 11A:
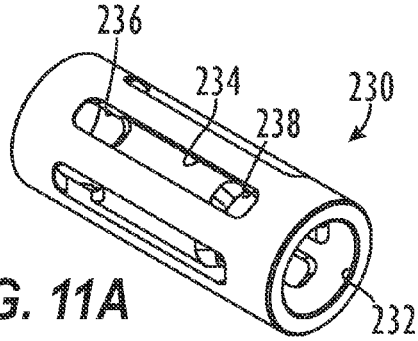
FIGS. 11A-11B illustrate a perspective view and a cross-sectional view of a flow insert of the landing assembly of FIG. 8.
Figure 11B:
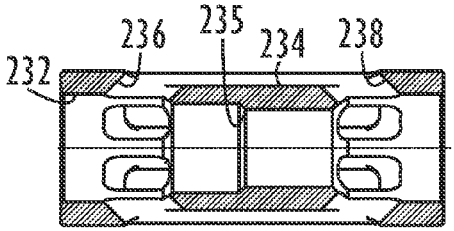

As best shown in FIG. 8, the flow insert 230 is positioned adjacent the coupled ends 216 and 256 of the housings 210 and 250. The flow insert 230, which is also shown in an isolated perspective view and a cross-sectional view in FIGS. 11A-11B, is intended to facilitate the flow of mud around internal components of the drop-off tool. As best shown in FIGS. 11A-11B, the flow insert 230 defines an internal bore 232 and has a plurality of slots 234 formed around the outside of the insert 230. Each slot 234 has ends 236 and 238 that communicate with the internal bore 232 through the insert 230. Mud in the internal bore 232 is able to flow through the open ends 236 and 238 and along the slots 234 to bypass passage through a central area of the insert 230. The central area of the insert 230 defines a landing ring 235 for engaging a landing collar of the drop-off tool discussed below. In one implementation, the landing ring 235 is formed by a change in the internal diameter of the internal bore 232 from about 2.75 to about 2.4-inches to form a shoulder in the bore 232.

Figure 12A:
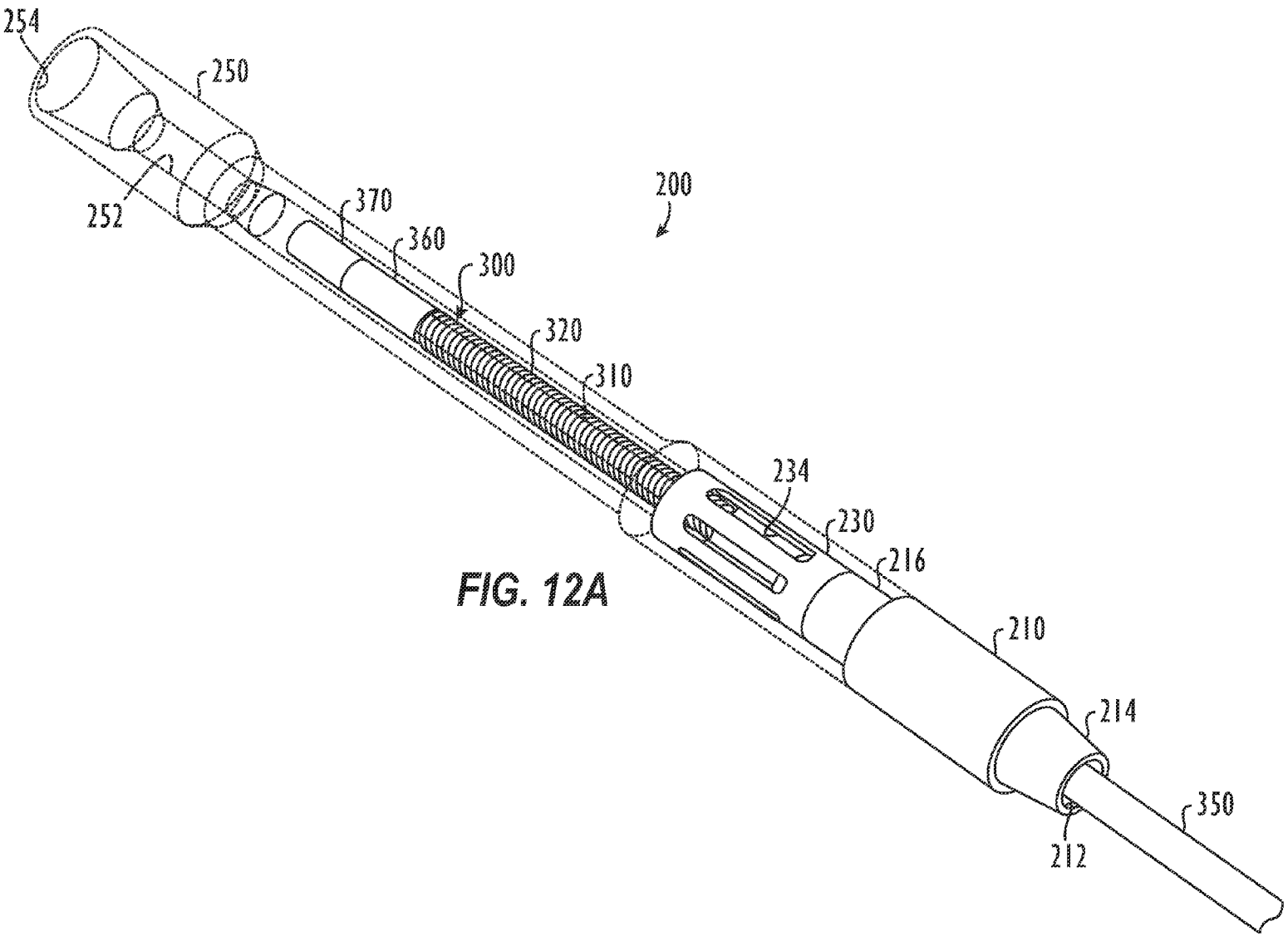
FIGS. 12A-12B illustrate a perspective view and a cross-sectional view of a wireline drop-off tool according to certain teachings of the present disclosure positioned within the landing assembly of FIG. 8.
Figure 12B:
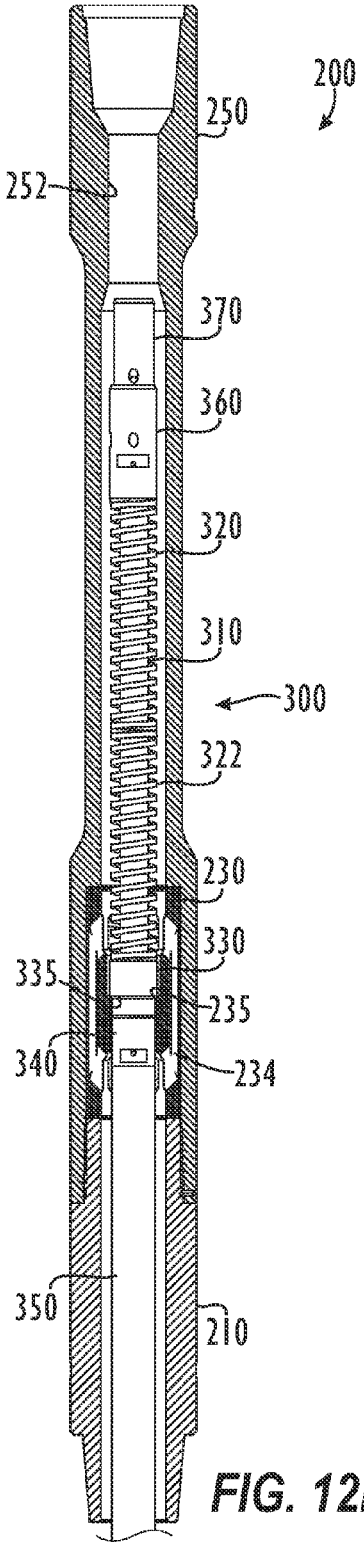
Figure 13A:
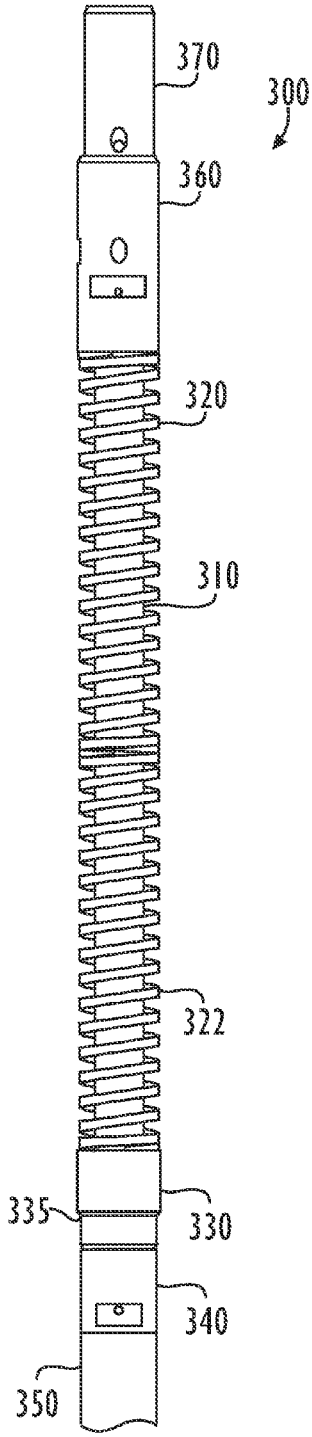
FIGS. 13A-13B illustrate a side view of various components of the wireline drop-off tool of FIGS. 12A-12B.
Figure 13B:
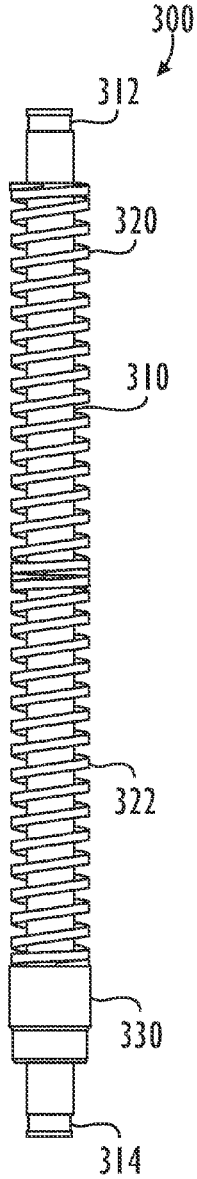

As discussed previously, the drop-off tool of the present disclosure is passed at least partially through the landing assembly on the pipe and portion of the drop-off tool engages an internal collar of the landing assembly to support the memory tools in a well hole beyond the landing assembly. Turning now to FIGS. 12A through 17B, an embodiment of a wireline drop-off tool 300 according to the present disclosure is illustrated in various views. FIGS. 12A-12B illustrates the drop-off tool 300 positioned in the landing assembly 200 of FIG. 8. FIG. 12A shows the upper housing 250 of the landing assembly 200 in dotted line to reveal components of the drop-off tool 300 positioned within the landing assembly 200. FIG. 12B illustrates a cross-sectional view of the landing assembly 200 with the drop-off tool 300 positioned within the assembly 200. FIGS. 13A through 13B illustrate various isolated views of components of the drop-off tool 300.

The drop-off tool 300 has an elongated body that includes a main bar 310, one or more springs 320 and 322, a landing collar 330, an extension bead 340, an extension tube 350, a fishneck interface 360, and an internal fishneck or fishing neck 370. As best shown in FIGS. 13A-13B, the springs 320 and 322 are positioned on the main bar 310, and the interface 360 is coupled to one end 312 of the main bar 310 so that an end of the "upper" spring 320 engages the interface 360. The landing collar 330 is positioned toward a second or "lower" end 314 of the main bar 310 and is engaged by an end of the "lower" spring 322. In addition, the extension bead 340 is coupled to the "lower" end 314 of the main bar 310. The landing collar 330 is allowed to move along the length of the bar 310 and is biased by the springs 320 and 322, which bias the landing collar 330 away from the fishneck interface 360 and the fishneck 370.

As best shown in the cross-sectional view of FIG. 12B, a shoulder 335 of the landing collar 330 is configured to engages the internal collar ring 235 of the flow insert 230 when the tool 300 is positioned in the landing assembly 200. The extension tube 350 extends beyond the open end of the lower housing 210 and holds the memory tools (not shown) within the well hole. Because the landing collar 330 can move along the main bar 310, the bias of the springs 320 and 322 can cushion the landing of the drop-off tool 300 within the landing assembly 200 when conveyed via wireline (not shown). The cushion landing can be beneficial for the memory tools (not shown) attached to the main bar 310 via the extension bead 340 and extension tube 350. As noted previously, the slots 234 along the outside of the flow insert 230 allow mud to flow past the engagement of the landing collar 330 and internal ring 235 within the central area of the insert 230.

Figure 14:
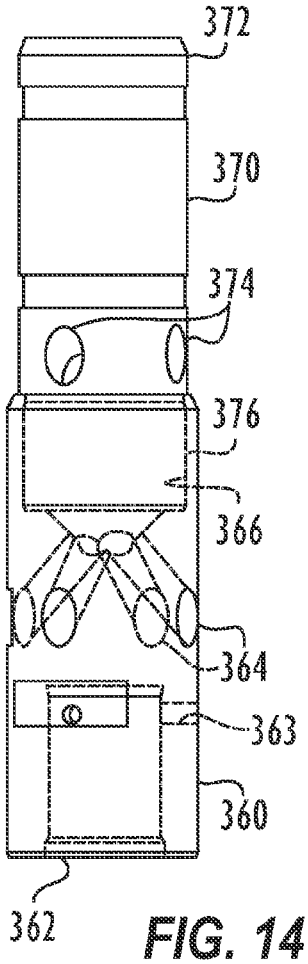
FIG. 14 illustrates a side view of an internal fishneck and an interface to the fishneck for the wireline drop-off tool.
Figure 17A:
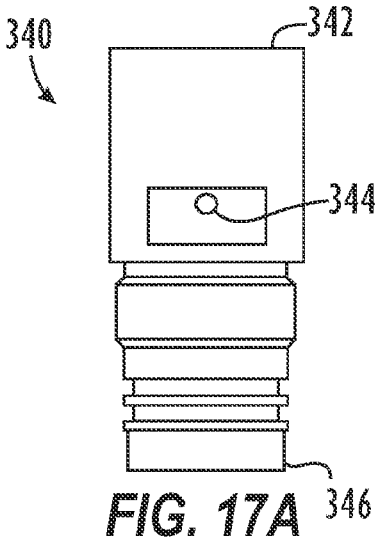
FIGS. 17A-17B illustrate a side view and a perspective view of an extension bead of the wireline drop-off tool.
Figure 17B:
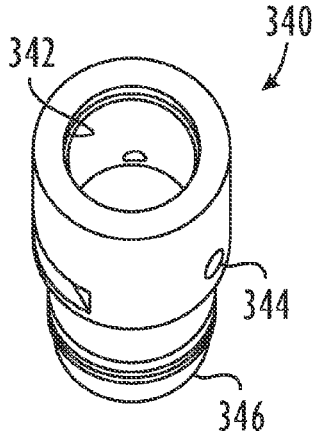

As best shown in FIG. 14, the fishneck interface 360 has a bored end 362 and side passages 363 for coupling the interface 360 onto the "upper" end (312) of the main bar (310) of FIG. 13B. As shown in FIGS. 17A-17B, the extension bead 340 similarly has a bored end 342 and side openings for coupling the bead 340 to the "lower" end (314) of the main bar (310) of FIG. 13B. In addition, the extension bead 340 has an end 346 for coupling to the extension tube (350) shown in FIG. 13A.

Figure 16:
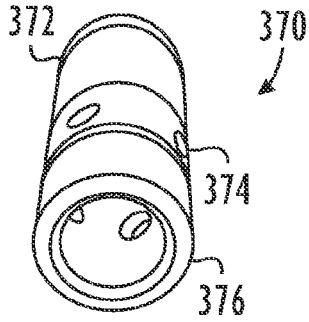
FIG. 16 illustrates a perspective view of the internal fishneck of the wireline drop-off tool.
Figure 15:
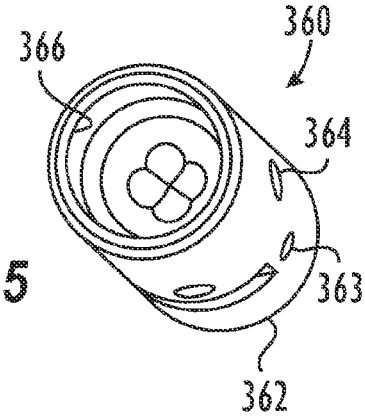
FIG. 15 illustrates a perspective view of the interface to the fishneck of the wireline drop-off tool.

As shown in FIGS. 14 through 16, another bored end 366 of the interface 360 receives an end 376 of the fishneck 370. The fishneck 374 is a hollow cylinder having slanted slots 374. These slanted slots 374 align with slanted slots 364 in the interface 360 and accommodate slips (not shown) for coupling the fishneck 370 to the interface 360. A retrieval/release mechanism (not shown) attached to the wireline is used to couple with and decouple from an "upper" end 372 of the fishneck 370. For example, the retrieval/release mechanism can be an electric and/or mechanical fishing tool or latch mechanism that enables the wireline to be remotely coupled to and de-coupled from the drop-off tool 300. Suitable fishing tools or latch mechanisms for use with the drop-off tool 300 can be obtained from Guardian Global Technology Limited and High Pressure Incorporated.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A memory tool deployment method, comprising:

fitting a landing assembly having a landing ring on an end of a pipe, the landing assembly defining at least one slot for communicating fluid around the landing ring;

deploying the pipe and the landing ring in a well;

connecting a memory tool to a wireline;

deploying the memory tool through the pipe in the well with the wireline;

landing the memory tool on the landing ring on the pipe by engaging a landing collar on the memory tool against the landing ring so that the memory tool extends exposed in the well beyond the end of the pipe;

releasing the memory tool from the wireline;

removing the wireline from the pipe; and allowing fluid flow between an interior of the pipe and the well beyond the end of the pipe by diverting fluid communication around the engagement of the landing collar against the landing ring via the at least one slot defined in the landing assembly.

2. The method of claim 1, further comprising:

redeploying the wireline in the pipe in the well;

reconnecting the memory tool to the wireline; and retrieving the memory tool from the pipe.

3. The method of claim 2, wherein the act of retrieving the memory tool from the pipe comprises:

determining if the memory tool can be pulled though the landing ring on the pipe;

retrieving the memory tool from the pipe with the wireline if the memory tool can be pulled though the landing ring; and removing the pipe and the memory tool together from the well if the memory tool cannot be pulled though the landing ring.

4. The method of claim 1, wherein the act of connecting the memory tool to the wireline further comprises connecting a well tractor to the wireline and the memory tool, and wherein the method further comprises actuating the well tractor to move the memory tool through the pipe if the memory tool becomes substantially hindered while deploying the memory tool through the pipe with the wireline.

5. The method of claim 1, wherein the act of landing the memory tool on the landing ring on the pipe comprises biasing the engagement of the landing collar on the memory tool against the landing ring.

6. The method of claim 1, wherein the act of landing the memory tool on the landing ring on the pipe comprises:

engaging the landing collar on the memory tool against an insert installed in the landing assembly, the insert having the landing ring and having the at least one slot allowing fluid flow to be diverted past the engagement of the landing collar against the landing ring.

7. The method of claim 1, further comprising:

moving the pipe at least partially out of the well; and obtaining data with the memory tool while moving the pipe.

8. A memory tool deployment system, comprising:

a landing assembly deployable on an end of a pipe in a well and defining a passage having a landing ring, the landing assembly defining at least one slot for communicating fluid around the landing ring;

a coupling member connectable to a coupling mechanism attached to a wireline deployable through the pipe; and a tool connected to the coupling member, the tool deployable with the wireline though the pipe and deployable at least partially through the passage in the landing assembly, the tool having a landing collar engageable with the landing ring and having a memory tool capable of extending exposed in the well beyond the landing ring and the end of the pipe, wherein the at least one slot in the landing assembly diverts fluid communication around the engagement of the landing collar with the landing ring and allows fluid flow between an interior of the pipe and the well beyond the end of the pipe.

9. The system of claim 8, wherein the landing assembly comprises:

a housing connecting to an end of the pipe and defining a first passage communicating with the pipe; and an insert positioned in the first passage of the housing and defining a second passage, the second passage having the landing ring, the insert defining the at least one slot for communicating fluid around the landing ring.

10. The system of claim 9, wherein the insert comprises an outside surface having the at least one slot, the at least one slot having first and second openings communicating with the second passage and disposed on opposing sides of the landing ring.

11. The system of claim 8, wherein the tool comprises an elongated body having first and second ends and having the landing collar thereon, the elongated body having the memory tool connected to the first end and having the coupling member connected to the second end.

12. The system of claim 11, wherein the landing collar is movable on the elongated body, and wherein the tool comprises at least one spring positioned on the elongated body and biasing movement of the landing collar relative to the second end of the elongated body.

13. The system of claim 11, wherein the coupling member connected to the tool comprises a fishneck connected to the second end of the elongated body and connectable to a fishing tool mechanism as the coupling mechanism attached to the wireline.

14. The system of claim 11, wherein the elongated body comprises:

a bar having the coupling member coupled to one end and having the landing collar moveably positioned thereon;

at least one spring positioned on the bar between the coupling member and the landing collar; and an extension member coupled to another end of the bar and supporting the memory tool.

15. The system of claim 8, further comprising a well tractor connecting to the wireline and connectable to the tool via the coupling mechanism attached to the wireline.

16. The system of claim 8, wherein the coupling member is configured to form a wet connection with the coupling mechanism to provide communication between the wireline and the memory tool.

17. The system of claim 8, wherein the tool comprises a mud pulse telemetric component positioned on the tool for communication with the memory tool.

18. A memory tool deployment apparatus comprising:

an insert disposable in a bore of a pipe in a well and defining an internal passage, the internal passage having a landing ring, the insert defining at least one slot for communicating fluid around the landing ring;

an elongated body having first and second ends and deployable with a wireline through the bore of the pipe, the first end having a memory tool;

a coupling member connected to the second end of the elongated body and connectable to a coupling mechanism attached to the wireline deployable through the bore of the pipe; and a landing collar positioned on the elongated body and engageable with the landing ring of the insert, wherein the at least one slot in the insert diverts fluid communication around the engagement of the landing collar with the landing ring and allows fluid flow between the bore of the pipe and the well beyond an end of the pipe.

19. The apparatus of claim 18, wherein the coupling member comprises a fishneck connected to the second end of the elongated body and connectable with a fishing tool mechanism as the coupling mechanism attached to the wireline.

20. The apparatus of claim 18, wherein the elongated body comprises:

a bar having the coupling member coupled to one end and having the landing collar moveably positioned thereon, wherein the at least one spring is positioned on the bar between the coupling member and the landing collar; and an extension member coupled to another end of the bar and supporting the memory tool.

21. The apparatus of claim 18, wherein the coupling member is configured to form a wet connection with the coupling mechanism to provide communication between the wireline and the memory tool.

22. The apparatus of claim 18, wherein the elongated body comprises a mud pulse telemetric component positioned on the elongated body for communication with the memory tool.

23. The apparatus of claim 18, wherein the landing collar is movable on the elongated body, and wherein the apparatus further comprises at least one spring positioned on the elongated body and biasing movement of the landing collar relative to the second end of the elongated body.

24. A memory tool deployment system, comprising:

means for deploying a memory tool with a wireline through a pipe in a well;

means for passing the memory tool through a landing ring on an end of the pipe;

means for engaging the landing ring to support the memory tool in the well beyond an end of the pipe;

means for releasing the memory tool from the wireline; and means on the landing ring for diverting fluid flow through at least one slot communicating fluid around the engagement of the memory tool with the landing ring to allow fluid communication between an interior of the pipe and the well beyond the end of the pipe.

25. The system of claim 24, further comprising means for subsequently retrieving the released memory tool from the pipe with the wireline.

26. The system of claim 24, wherein the means for deploying the memory tool with the wireline through the pipe in the well comprise means for moving the memory tool through the pipe if the memory tool becomes substantially hindered while deploying the memory tool through the pipe with the wireline.

27. The system of claim 24, wherein the means for engaging the landing ring to support the memory tool in the well beyond the end of the pipe comprises means for biasing the engagement with the landing ring.

28. The system of claim 24, wherein the means for releasing the memory tool from the wireline comprises means for electrically uncoupling connection between the wireline and the memory tool.

* * * * *

UNITED STATES PATENT AND TRADEMARK OFFICE

CERTIFICATE OF CORRECTION

PATENT NO. : 7,537,061 B2
APPLICATION NO. : 11/423909
DATED : May 26, 2009
INVENTOR(S) : Joe Hall et al.

It is certified that error appears in the above-identified patent and that said Letters Patent is hereby corrected as shown below:

col. 9 line 45 should read:
"if the memory tool can be pulled through the landing ring;"

col. 9 line 48 should read:
"well if the memory tool cannot be pulled through the"

Signed and Sealed this

Fourteenth Day of July, 2009

John Doll

JOHN DOLL
*Acting Director of the United States Patent and Trademark Office*